US010530036B2

(12) United States Patent
Talty et al.

(10) Patent No.: US 10,530,036 B2
(45) Date of Patent: Jan. 7, 2020

(54) DUALBAND FLEXIBLE ANTENNA WITH SEGMENTED SURFACE TREATMENT

(71) Applicant: GM GLOBAL TECHNOLOGY OPERATIONS LLC, Detroit, MI (US)

(72) Inventors: Timothy J. Talty, Beverly Hills, MI (US); Hyok Jae Song, Oak Park, CA (US); James H. Schaffner, Chatsworth, CA (US); Duane S. Carper, Davison, MI (US); Eray Yasan, Canton, MI (US)

(73) Assignee: GM GLOBAL TECHNOLOGY OPERATIONS, LLC, Detroit, MI (US)

( * ) Notice: Subject to any disclaimer, the term of this patent is extended or adjusted under 35 U.S.C. 154(b) by 205 days.

(21) Appl. No.: 15/348,470

(22) Filed: Nov. 10, 2016

(65) Prior Publication Data

US 2017/0324138 A1 Nov. 9, 2017

Related U.S. Application Data

(60) Provisional application No. 62/332,705, filed on May 6, 2016.

(51) Int. Cl.

| | |
|---|---|
| ***H01Q 1/12*** | (2006.01) |
| ***H01Q 5/371*** | (2015.01) |
| ***H01Q 5/378*** | (2015.01) |
| ***H01Q 1/32*** | (2006.01) |
| ***H01Q 5/328*** | (2015.01) |
| ***H01Q 13/20*** | (2006.01) |

(52) U.S. Cl.
CPC ..... *H01Q 1/1271* (2013.01); *H01Q 1/3291* (2013.01); *H01Q 5/328* (2015.01); *H01Q 5/371* (2015.01); *H01Q 5/378* (2015.01); *H01Q 13/20* (2013.01)

(58) Field of Classification Search
CPC .... H01Q 1/1271; H01Q 5/25; H01Q 15/0006; H01Q 15/0013; H01Q 5/378; H01Q 5/392; H01Q 5/40; H01Q 13/20
See application file for complete search history.

(56) References Cited

U.S. PATENT DOCUMENTS 7,006,043 B1 * 2/2006 Nalbandian ..... H01Q 9/0407 343/700 MS
7,042,414 B1 * 5/2006 Lee ..... H01Q 1/243 343/795

(Continued)

*Primary Examiner* — Dameon E Levi
*Assistant Examiner* — Jennifer F Hu
(74) *Attorney, Agent, or Firm* — Lorenz & Kopf, LLP

(57) ABSTRACT

An antenna structure including a dual-band WiFi CPW antenna formed on a dielectric substrate and a frequency selective impedance surface formed on the substrate and at least partially surrounding the antenna. The antenna includes a ground plane defining a gap and an antenna radiating element including a radiating portion positioned proximate to the ground plane and a feed line extending into the gap. The frequency selective impedance surface can be a ring that is configured around the radiating portion of the radiating element, where the frequency selective impedance ring receives surface waves propagating along the dielectric substrate generated by the antenna.

11 Claims, 3 Drawing Sheets

(56) References Cited

U.S. PATENT DOCUMENTS

| | | | | |
|---|---|---|---|---|
| 7,847,737 | B2 * | 12/2010 | Kuroda | H01Q 9/0407 343/700 MS |
| 8,339,330 | B2 * | 12/2012 | Yun | H01Q 15/0013 343/912 |
| 2007/0040756 | A1 * | 2/2007 | Song | H01Q 1/1271 343/713 |
| 2007/0159395 | A1 * | 7/2007 | Sievenpiper | H01Q 9/30 343/700 MS |
| 2007/0290939 | A1 * | 12/2007 | Teshirogi | H01Q 1/38 343/795 |
| 2008/0068269 | A1 * | 3/2008 | Yamada | H01Q 1/38 343/700 MS |
| 2009/0015496 | A1 * | 1/2009 | Liu | H01Q 9/0457 343/742 |
| 2010/0066621 | A1 * | 3/2010 | Chang | H01Q 9/40 343/767 |
| 2010/0201584 | A1 * | 8/2010 | Schaffner | H01Q 1/3275 343/713 |
| 2010/0328164 | A1 * | 12/2010 | Huynh | H01Q 1/243 343/702 |
| 2015/0130677 | A1 * | 5/2015 | Maier | H01Q 1/2216 343/837 |
| 2015/0214629 | A1 * | 7/2015 | Hagiwara | H01Q 21/205 343/727 |
| 2015/0343884 | A1 * | 12/2015 | Rousselet | B32B 17/10192 359/360 |
| 2016/0345427 | A1 * | 11/2016 | Ishiwata | H01L 23/552 |
| 2017/0294714 | A1 * | 10/2017 | Lindenmeier | H01Q 1/3275 |

* cited by examiner

DUALBAND FLEXIBLE ANTENNA WITH SEGMENTED SURFACE TREATMENT

CLAIM OF BENEFIT TO PRIOR APPLICATION

This application claims benefit to U.S. Provisional Patent Application 62/332,705, entitled "Dualband Flexible WIFI Antenna with Segmented Surface Treatment" filed May 6, 2016. The U.S. Provisional Patent Application 62/332,705 is incorporated herein by reference.

BACKGROUND

Field of the Disclosure

This disclosed system relates generally to an antenna structure including an antenna and a frequency selective impedance surface surrounding the antenna printed on a flexible substrate and, more particularly, to a dual-band co-planar (CPW) antenna structure mounted to vehicle glass and including a frequency selective impedance surface surrounding an antenna that reduces the effects of surface waves.

Discussion of the Related Art

Modern vehicles employ various and many types of antennas to receive and transmit signals for different communications systems, such as terrestrial radio (AM/FM), cellular telephone, satellite radio, dedicated short range communications (DSRC), WiFi, GPS, etc. Further, cellular telephone is expanding into 4G long term evolution (LTE) that requires two antennas to provide multiple-input multiple-output (MIMO) operation. The antennas used for these systems are often mounted to a roof of the vehicle so as to provide maximum reception capability. Further, many of these antennas are often integrated into a common structure and housing mounted to the roof of the vehicle, such as a "shark-fin" roof mounted antenna module. As the number of antennas on a vehicle increases, the size of the structures required to house all of the antennas in an efficient manner and provide maximum reception capability also increases, which interferes with the design and styling of the vehicle. Because of this, automotive engineers and designers are looking for other suitable areas on the vehicle to place antennas that may not interfere with vehicle design and structure.

One of those areas is vehicle glass, such as the vehicle windshield, which has benefits because glass makes a good dielectric substrate for an antenna. For example, it is known in the art to print AM and FM antennas on the glass of a vehicle, where the printed antennas are fabricated with the glass as a single piece. However, these known antennas are generally limited in that they could only be placed in a vehicle windshield or other glass surface in areas where viewing through the glass was not necessary.

When an antenna is placed on a dielectric substrate energy generated by the antenna for both transmission and reception purposes gets coupled at least in part into the substrate where surface waves can be created. For example, the thickness of an automotive windshield and other glass is typically in the range of 3-5 mm, which is electrically thick at the 5.8 GHz WiFi frequency band. When antennas are flush mounted to electrically thick substrates surface waves arise that can result in undesired scattering and a reduction in antenna efficiency and gain. Those surface waves expand out from the antenna along the substrate until they reach the edge of the substrate, where they are either radiated in an undesirable fashion or dissipated or coupled into conductive structures, such as where vehicle glass is coupled to the metallic vehicle body. Thus, much of the energy that is to be radiated by the antenna is lost, reducing the efficiency and performance of the antenna.

Surface waves occur in situations where an electrically thick substrate compared to the signal wavelength supports surfaces waves. Surface waves can be created by printed antennas or antennas that are flush mounted to a substrate. This can be particularly problematic for wideband antennas, where the substrate happens to be electrically thick at some frequencies and electrically thin at other frequencies within the operating bandwidth of the antenna. Surface waves can also be created by incident energy from a distant source, that is, sources not directly mounted on the structure of interest. The presence of surface waves can result in undesired scattering, reduction in antenna gain, and can damage or interfere with the operation of other sensitive electronics on the same structure.

Holographic and sinusoidally modulated impedance surfaces have been used to control surface waves. A bound surface wave mode is perturbed in a sinusoidal fashion to create slow leakage and directive radiation. To date, these surfaces have not been used as an integrated or retrofitted treatment to a separate antenna. Typically, holographic and sinusoidally modulated surfaces are antennas that must be customized based on their excitation source to achieve the specified radiation angle, and are designed to control the transverse magnetic (TM) mode and required grounded substrates for this reason. Versions of the holographic antenna that do not require a grounded substrate and control the transverse electric (TE) mode have been demonstrated, but they required the thickness of the substrate to be varied in order to achieve radiation.

SUMMARY OF THE INVENTION

The present invention discloses and describes an antenna structure including a dual-band WiFi CPW antenna formed on a dielectric substrate and a frequency selective impedance surface formed on the substrate and at least partially surrounding the antenna. The antenna includes a ground plane defining a gap and an antenna radiating element including a radiating portion positioned proximate to the ground plane and a feed line extending into the gap. The frequency selective impedance surface can be a ring that is configured around the radiating portion of the radiating element, where the frequency selective impedance ring receives surface waves propagating along the dielectric substrate generated by the antenna.

Additional features of the present invention will become apparent from the following description and appended claims, taken in conjunction with the accompanying drawings.

DETAILED DESCRIPTION OF THE EMBODIMENTS

The following discussion of the embodiments of the invention directed to an antenna structure including an antenna mounted on a dielectric substrate and a frequency selective impedance surface surrounding the antenna is merely exemplary in nature, and is in no way intended to limit the invention or its applications or uses. For example, the discussion herein talks about the antenna structure being applicable to be mounted to vehicle glass. However, as will be appreciated by those skilled in the art, the antenna structure will have application for other dielectric structures, such as plastics, other than automotive structures.

Figure 1:
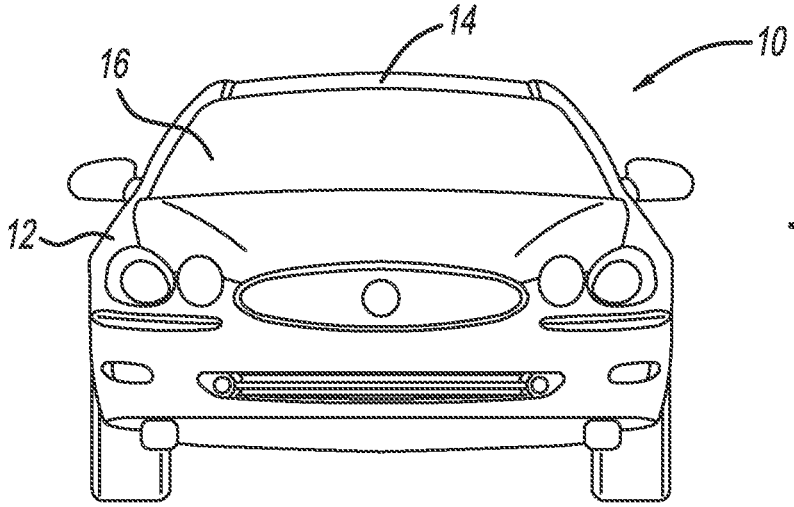
FIG. 1 is a front view of a vehicle showing a vehicle windshield.
Figure 2:
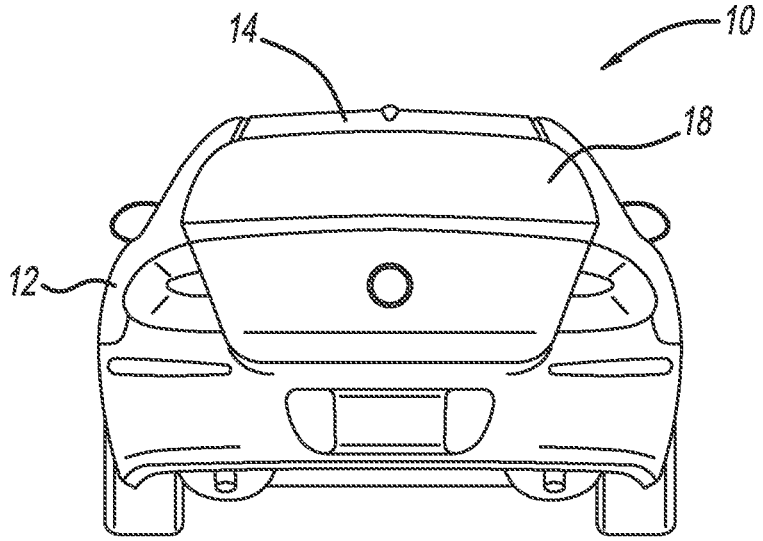
FIG. 2 is a rear view of the vehicle showing a vehicle rear window.

FIG. 1 is a front view of a vehicle 10 including a vehicle body 12, roof 14 and windshield 16, and FIG. 2 is a rear view of the vehicle 10 showing a rear window 18. As will be discussed in detail below, the present invention proposes providing a wideband antenna on the windshield 16, the rear window 18, or any other window or dielectric structure on the vehicle 10, where the antenna is flexible to conform to the shape of the particular dielectric structure, and where the antenna can be mounted at any suitable location on the dielectric structure, including locations on the windshield 16 that the vehicle driver needs to see through. In one embodiment, the antenna is a wideband monopole appliqué antenna that is installed directly on the surface of the dielectric structure by a suitable adhesive. The antenna structure can be designed to operate on automotive glass of various physical thicknesses and dielectric properties, where the antenna structure operates as intended when installed on the glass or other dielectric since in the design process the glass or other dielectric is considered in the antenna geometry pattern development.

The antenna can be a single layer co-planar antenna with a single feed that operates at 5.9 GHz, radiates linear polarization, and mitigates the negative effects of surface waves by converting the surface wave energy into leaky-wave radiation. The antenna may have a co-planar type of geometry where both radiator and ground plane conductors are patterned onto a thin flexible film substrate, such as a copper/kapton film, which is ultimately mounted on a carrier substrate for final installation. The window glass is regarded as the microwave substrate with a thickness of 4 mm and relative permittivity of ~5.6, where the windshield thickness of 4 mm is electrically thick compared to the signal wavelength at the operating frequency of 5.9 GHz for DSRC frequencies. The antenna radiator is fed by a co-planar waveguide (CPW) and can be connected to a coaxial cable. The CPW feed structure has advantages, such as low radiation loss, less dissipation and easy integration with RF/microwave circuits, thus enabling a miniature hybrid or monolithic microwave integrated circuit (MMIC).

Figure 3:
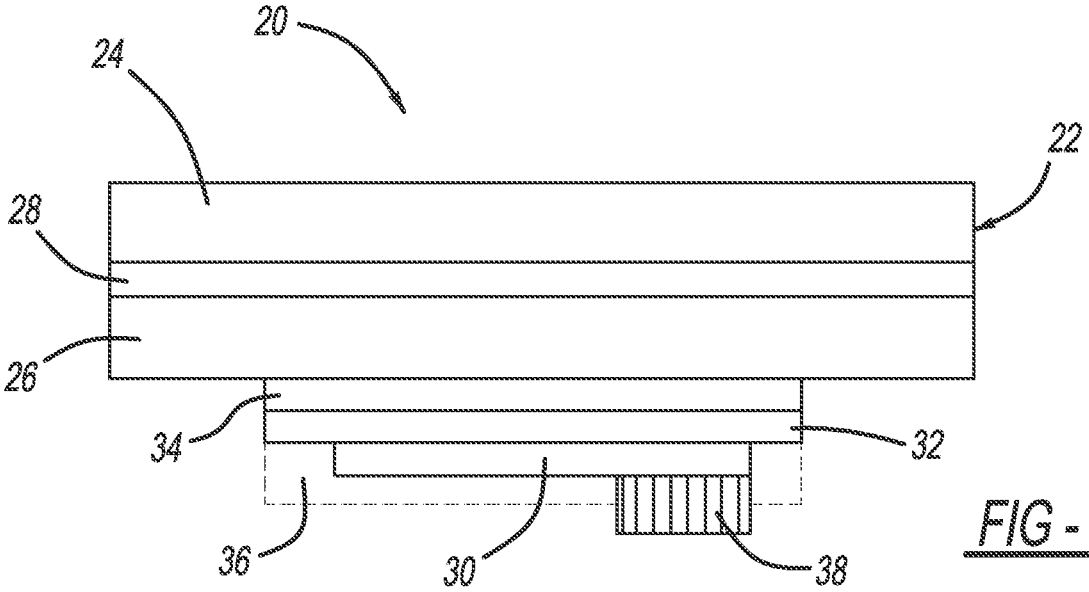
FIG. 3 is a profile view of a vehicle window including a thin film, flexible antenna formed thereon.

FIG. 3 is a profile view of an antenna structure 20 including a windshield 22 having an outer glass layer 24, an inner glass layer 26 and a polyvinyl butyral (PVB) layer 28 therebetween. The structure 20 includes an antenna 30 formed on a thin, flexible film substrate 32, such as polyethylene terephthalate (PET), biaxially-oriented polyethylene terephthalate (BoPET), flexible glass substrates, mylar, Kapton, etc., and adhered to a surface of the layer 26 by an adhesive layer 34. The adhesive layer 34 can be any suitable adhesive or transfer tape that effectively allows the substrate 32 to be secured to the glass layer 26, and further, if the antenna 30 is located in a visible area of the glass layer 26, the adhesive or transfer tape can be transparent or near transparent so as to have a minimal impact on the appearance and light transmission therethrough. The antenna 30 can be protected by a low RF loss passivation layer 36, such as parylene. An antenna connector 38 is shown connected to the antenna 30 and can be any suitable RF or microwave connector such as a direct pig-tail or coaxial cable connection. Although the antenna 30 is shown being coupled to an inside surface of the inner glass layer 26, the conductor 30 can be adhered to the outer surface of the outer glass layer 24 or the surface of the layers 24 or 26 adjacent to the PVB layer 28 or the surfaces of the PVB layer 28.

The antenna 30 can be formed by any suitable low loss conductor, such as copper, gold, silver, silver ceramic, metal grid/mesh, etc. If the antenna 30 is at a location on the vehicle glass that requires the driver or other vehicle occupant to see through the glass, then the antenna conductor can be any suitable transparent conductor, such as indium tin oxide (ITO), silver nano-wire, zinc oxide (ZnO), etc. Performance of the antenna 30 when it is made of a transparent conductor could be enhanced by adding a conductive frame along the edges of the antenna 30 as is known in the art.

The thickness of automotive glass may vary approximately over 2.8 mm-5 mm and have a relative dielectric constant $\varepsilon_r$ in the range of 4.5-7.0. The antenna 30 includes a single layer conductor and a co-planar waveguide (CPW) feed structure to excite the antenna radiator. The CPW feed structure can be configured for mounting the connector 38 in a manner appropriate for the CPW feed line or for a pigtail or a coaxial cable. When the connector 38 or the pigtail connection to the CPW line is completed, the antenna 30 can be protected with the passivation layer 36. In one embodiment, when the antenna 30 is installed on the glass, a backing layer of the transfer tape can be removed. By providing the antenna conductor on the inside surface of the vehicle windshield 22, degradation of the antenna 30 can be reduced from environmental and weather conditions.

As discussed above, the present invention discloses an antenna structure that is operable to receive and transmit signals in the WiFi frequency bands with appropriate polarization when mounted or integrated on the vehicle glass. The antenna structure can be shaped and patterned into a transparent conductor and a co-planar structure where both the antenna and ground conductors are printed on the same layer. The antenna can use low cost thin films made of transparent conductive oxides and silver nano-wires with a high conductivity metal frame surrounding the antenna elements.

Figure 4:
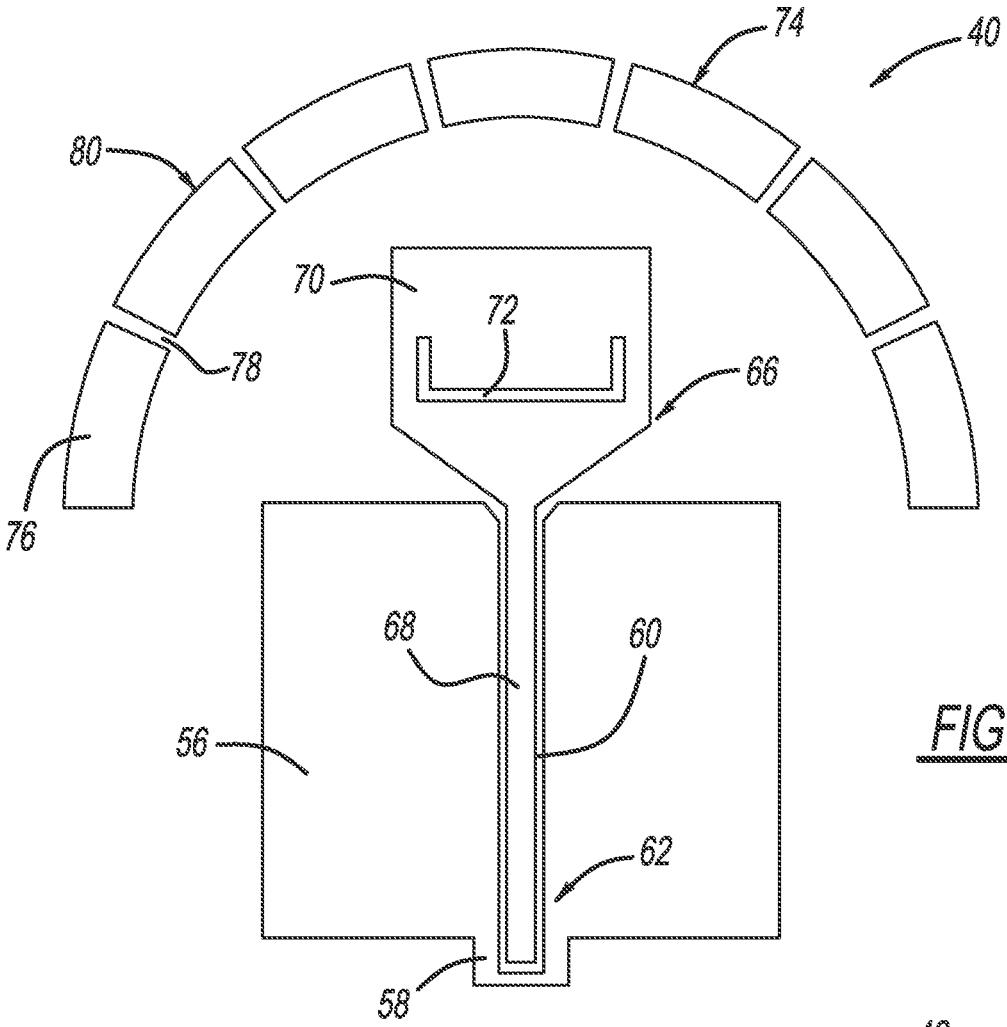
FIG. 4 is a top view of a dual-band WiFi CPW antenna structure including a semi-circular frequency selective impedance surface separated into segments.
Figure 5:
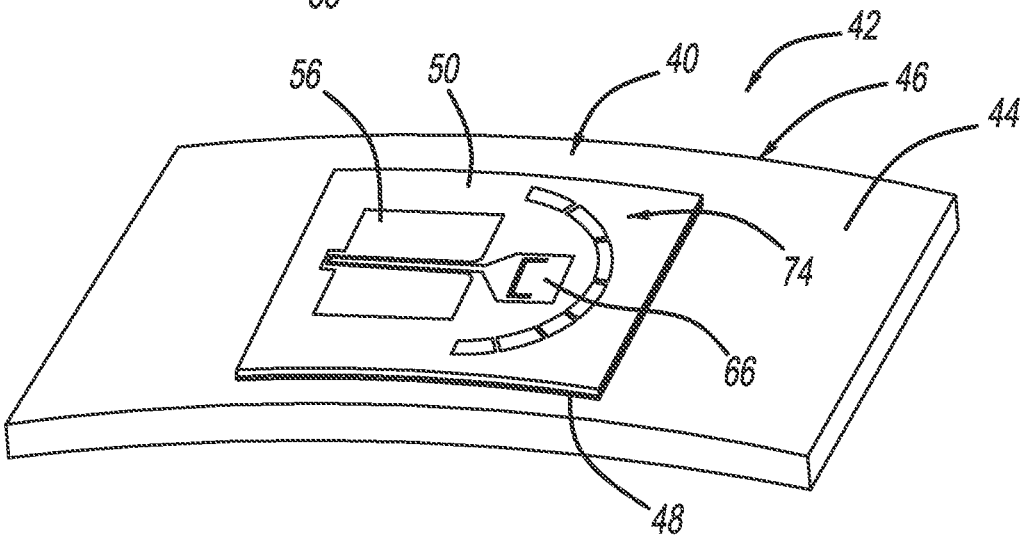
FIG. 5 is an isometric view of the antenna structure shown in FIG. 4 adhered to a glass substrate.

FIG. 4 is a top view of an antenna structure 40 that has application to operate as a dual-band WiFi antenna in the 2.4 GHz and 5.8 GHz WiFi frequency bands. FIG. 5 is an isometric illustration 42 of the antenna structure 40 formed to a thin film 50, and secured to a surface 44 of a curved vehicle glass 46 by an adhesive layer 48. The antenna structure 40 includes a ground plane 56 having a cut-out slot 60 therein, and an extension portion 58 that is part of a CPW feed structure 62. The antenna structure 40 further includes an antenna radiating element 66 having a feed line 68 that is also part of the feed structure 62 extending into the slot 60 and being electrically isolated from the ground plane 56, and a pentagon-shaped radiating portion 70 coupled thereto. The radiating portion 70 has a shape and size to operate in the 2.4 GHz and 5.8 GHz WiFi frequency bands, where a U-shaped slot 72 is formed in the radiating portion 70 to provide band rejection between the two separate WiFi frequency bands.

The antenna structure 40 also includes a shaped frequency selective impedance surface 74 defined by a semi-circular segmented ring 80 including a series of ring segments 76 defining gaps 78 therebetween, where the frequency selective impedance surface 74 partially surrounds the radiating portion 70, as shown, and operates to scatter and disturb surface waves propagating the glass 46. The ring 80 can be segmented to satisfy the conditions that the segment arc length is ≥0.25λ at the higher 5.8 GHz WiFi frequency band and is much less than 0.25λ at the lower 2.4 GHz WiFi frequency band. The condition for the arc length is to ensure that the ring surface treatment is electrically large enough to interact with the surface waves at the higher WiFi frequency band and is also electrically small enough to be RF transparent to the lower WiFi frequency band. Further, although the gaps 78 have parallel edges where the spacing is the same across the entire gap 78, in alternate designs, the gaps 78 can be flared to provide the desired interaction of the signals therein.

As mentioned above, the antenna structure 40 has particular application for the 2.4 GHz and 5.8 GHz WiFi frequency bands. For these bands, in this embodiment, the antenna structure 40 has the following dimensions. The radius of the segment ring 80 is 29 mm, the width of the gap 78 is 1 mm, the width of the slot 72 is 1 mm, the width of the radiating portion 70 is 19.4 mm, the height of the square part of the radiating portion 70 is 13.4 mm, the length of the ground plane 56 is 32.2 mm, the distance from the center of the gap 60 to the outside edge of the ground plane 58 is 19.4 mm and the width of the gap 60 is 2.7 mm.

Figure 6:
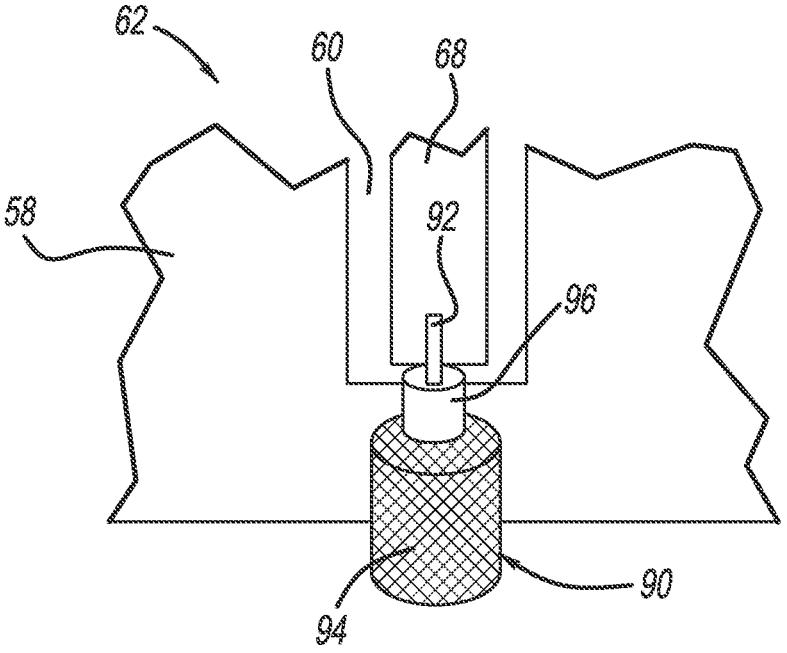
FIG. 6 is a cut-away feed structure of the antenna structure shown in FIG. 4.

Any suitable feed structure can be employed for feeding the antenna radiating portion 70. FIG. 6 is a top, cut-away view of the CPW antenna feed structure 62 showing one suitable example. In this embodiment, a coaxial cable 90 provides the signal line coupled to the feed structure 62 and includes an inner conductor 92 electrically coupled to the signal line 68 and an outer ground conductor 94 electrically coupled to the ground portion 58, where the conductors 92 and 94 are separated by an insulator 96.

The segmented ring 80 includes seven equally sized segments 76 in the antenna structure 40. In other designs, the number and size of the ring segments 76 can be different for different frequency bands. Also, the shape of the ring 80 can be altered, such as elliptical.

Figure 7:
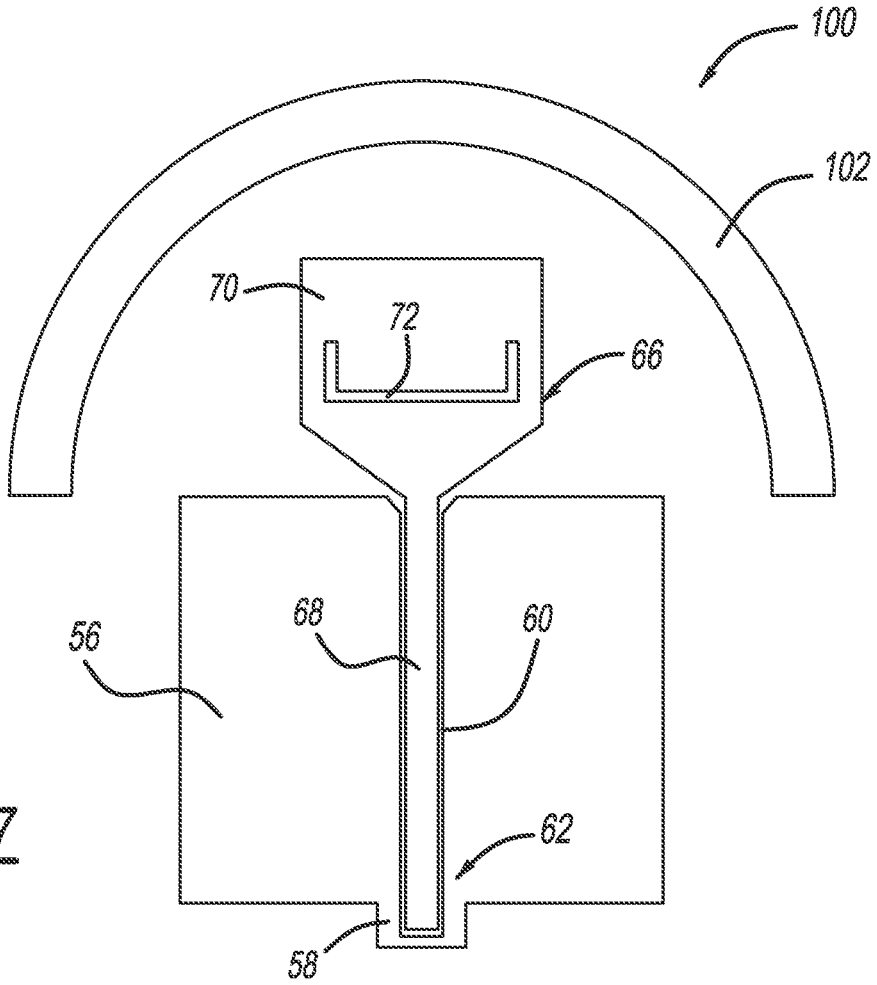
FIG. 7 is a top view of a dual-band WiFi antenna structure including a semi-circular frequency selected impedance ring.

FIG. 7 is a top view of an antenna structure 100 similar to the antenna structure 40, where like elements are identified by the same reference number. In this design, the segmented ring 80 is replaced with a non-segmented ring 102 that is a single conductive semi-circular metal layer to provide the reduced surface wave affect.

Another exemplary embodiment of a frequency selective surface may include the use of a periodic and random material dots or patterns to used break up the surface wave. The dot pattern may be fabricated from a dielectric material with a dielectric constant different from that of the dielectric substrate. This discontinuity in dielectrics can cause a reflection coefficient significant enough to disrupt the unwanted surface waves or signal propagation along the dielectric substrate. Alternatively, the dots may be conductive in order to reflect and/or contain the signal at the desired frequency. The dots may be spaced at intervals less than 0.5λ and preferably 0.25λ at the highest desired frequency. The dot pattern may be applied in a manner similar to printed traces on a circuit board. Alternatively, the dots may be created using vias or through vias at the appropriate spacing. The dots may alternatively consist of geometric shapes of any geometry in order to obtain the frequency selective results. The geometric shapes may include, but are not limited to, triangles, squares, rectangles, polygons, etc.

Another exemplary embodiment of a frequency selective surface may include the use of irregularities or changes in the dielectric material within the dielectric substrate in order to create an impedance mismatch significant enough to perform as a frequency selective surface. For example, changes in thickness of substrate; changes in the composition of the substrate, use of ultra-violet light to change the dielectric properties of a polyvinyl butyral (PVB) or ethylene-vinyl acetate (EVA) substrate used in-between layer of the windshield glass.

In another exemplary embodiment, in the instance when there may be an conductive layer applied to the dielectric substrate, portions of the conductive layer may be removed in order to reduce the conductivity of the conductive layer at the desired frequency. For example, some suppliers may coat the entire dielectric substrate with conductive material and then use a subtractive process to remove areas of the conductive material. In this instance, holes could be incorporated to create an imperfect ground plane—and impedance changes—that would disrupt the formation of the surface wave. For example, dots could be removed, a segmented ring generated or a not segmented ring generated in order to achieve the frequency selective results.

In addition to the implementation here, that uses substrates that contain antennas and surface wave suppression elements that are adhered to the glass, the antennas and surface waves can be embedded into the glass structures. There are various methods to add conductive elements to glass; including adding silver-ceramic paint that is commonly used on automotive back-glass for heating/de-icing; addition of conductive coating to one of the layers of glass in a windshield and/or incorporating conductive elements in the PVB, or similar, layers of the glass.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An antenna structure comprising:

a dielectric substrate having an inner surface and an outer surface;

an antenna formed directly on the outer surface of the dielectric substrate; and a frequency selective impedance element formed directly on the outer surface of the dielectric substrate and being configured around a radiating portion of a radiating element such that the frequency selective impedance element and the antenna form a co-planar structure, the frequency selective impedance element is a semi-circular ring, and the frequency selective impedance element receiving surface waves propagating along the dielectric substrate generated by the antenna.

2. The antenna structure according to claim 1 wherein the frequency selective impedance element is a segmented ring including a plurality of ring segments separated by gaps.

3. The antenna structure according to claim 2 wherein the gaps have a flared shape formed by end edges of the adjacent ring segments.

4. The antenna structure according to claim 1 wherein the radiating portion has a pentagon shape.

5. The antenna structure according to claim 1 wherein the antenna is a dual-band antenna and the radiating element includes a slot for rejecting frequencies between a first band and a second band.

6. The antenna structure according to claim 1 wherein the frequency selective impedance element is formed using a dielectric material with a dielectric constant different than that of the dielectric substrate.

7. The antenna structure according to claim 1 further comprising a CPW feed structure being electrically coupled to a ground plane and the radiating element.

8. The antenna structure according to claim 1 wherein the dielectric substrate is affixed to a vehicle window.

9. The antenna structure according to claim 1 further comprising an adhesive layer formed on the inner surface of the dielectric substrate.

10. The antenna structure according to claim 1 wherein the antenna includes transparent conductors.

11. The antenna structure according to claim 1 wherein the antenna and frequency selective impedance element are formed on a thin film substrate selected from the group consisting of mylar, Kapton, PET and flexible glass substrates.

* * * * *